US009551333B2

(12) United States Patent
Turner et al.

(10) Patent No.: US 9,551,333 B2
(45) Date of Patent: Jan. 24, 2017

(54) VACUUM PUMP WITH LONGITUDINAL AND ANNULAR SEALS

(75) Inventors: Neil Turner, Godalming (GB); Stephen Dowdeswell, Cuckfield (GB); Sivabalan Kailasam, Worthing (GB); Alan Ernest Kinnaird Holbrook, Pulborough (GB)

(73) Assignee: Edwards Limited, Crawley (GB)

( * ) Notice: Subject to any disclaimer, the term of this patent is extended or adjusted under 35 U.S.C. 154(b) by 695 days.

(21) Appl. No.: 14/006,575

(22) PCT Filed: Jan. 17, 2012

(86) PCT No.: PCT/GB2012/050087

§ 371 (c)(1),
(2), (4) Date: Sep. 20, 2013

(87) PCT Pub. No.: WO2012/127198

PCT Pub. Date: Sep. 27, 2012

(65) Prior Publication Data

US 2014/0017062 A1 Jan. 16, 2014

(30) Foreign Application Priority Data

Mar. 22, 2011 (GB) ..... 1104781.8

(51) Int. Cl.
*F01C 19/00* (2006.01)
*F01C 19/10* (2006.01)
(Continued)

(52) U.S. Cl.
CPC ..... *F04B 25/00* (2013.01); *F01C 19/005* (2013.01); *F01C 19/10* (2013.01); *F01C 21/10* (2013.01);
(Continued)

(58) Field of Classification Search
CPC ..... F16T 15/00; F16T 15/02; F16T 15/021; F16T 15/022; F16T 15/06; F16T 15/062
(Continued)

(56) References Cited

U.S. PATENT DOCUMENTS 4,869,658 A 9/1989 Tsutsumi et al.
6,572,351 B2 * 6/2003 Durand ..... F01C 21/104 418/149
(Continued)

FOREIGN PATENT DOCUMENTS

CN 101815873 A 8/2010
EP 2071191 A2 6/2009
(Continued)

OTHER PUBLICATIONS

Translation of Japanese Rejection from counterpart Japanese Patent Application No. 2014-500466, dated Aug. 31, 2015, 3 pp.
(Continued)

*Primary Examiner* — Kenneth Bomberg
*Assistant Examiner* — Deming Wan
(74) *Attorney, Agent, or Firm* — Shumaker & Sieffert, P.A.

(57) ABSTRACT

A multi-stage vacuum pump may include first and second half-shell components defining a plurality of pumping chambers and for assembly together along respective longitudinal extending faces; first and second end stator components for assembly at respective longitudinal seals for sealing between the first and second half-shell stator components when assembled together at the longitudinally extending faces; and annular seals for sealing between the first and second end stator components and the first and second half-shell stator components when assembled; wherein the longitudinal seals have end portions which abut against the annular seals for sealing therebetween and the first and second
(Continued)

half-shell stator components have formations for resisting movement of the end portions away from the annular seals when the end portions are compressed between the first and second half-shell stator components.

20 Claims, 8 Drawing Sheets

(51) Int. Cl.

| | |
|---|---|
| ***F16J 15/02*** | (2006.01) |
| ***F01C 1/24*** | (2006.01) |
| ***F03C 2/30*** | (2006.01) |
| ***F04C 2/24*** | (2006.01) |
| ***F04C 18/24*** | (2006.01) |
| ***F04B 25/00*** | (2006.01) |
| ***F01C 21/10*** | (2006.01) |
| ***F04C 23/00*** | (2006.01) |
| ***F04C 25/02*** | (2006.01) |
| ***F04C 27/00*** | (2006.01) |
| ***F04C 18/12*** | (2006.01) |

(52) U.S. Cl.
CPC ..... *F04C 18/12* (2013.01); *F04C 23/001* (2013.01); *F04C 25/02* (2013.01); *F04C 27/008* (2013.01); *F04C 2230/60* (2013.01)

(58) Field of Classification Search
USPC ..... 418/9, 206.1, 206.6, 131, 132; 277/630, 277/637, 641, 644
See application file for complete search history.

(56) References Cited

U.S. PATENT DOCUMENTS

| | | | |
|---|---|---|---|
| 9,279,426 | B2 | 3/2016 | Schofield et al. |
| 2002/0155014 | A1 | 10/2002 | Durand et al. |

FOREIGN PATENT DOCUMENTS

| | | | | | |
|---|---|---|---|---|---|
| EP | 2192304 | A1 | | 6/2010 | |
| GB | 2340898 | A | * | 3/2000 | ..... F16J 15/062 |
| JP | 04100297 | A | | 4/1992 | |
| JP | 04153581 | A | | 5/1992 | |
| JP | 2003016801 | A | | 1/2003 | |
| JP | 2003042079 | B2 | | 2/2003 | |
| JP | 2004507641 | A | | 3/2004 | |
| JP | 2006236611 | A | | 9/2006 | |
| JP | 2010540832 | A | | 12/2010 | |
| WO | 2009044197 | A2 | | 4/2009 | |
| WO | 2009044197 | A3 | | 4/2009 | |

OTHER PUBLICATIONS

Translation of Office Action from Counterpart Chinese Application No. 201280014037.9, dated May 5, 2015, 12 pp.
Search Report under Section 17(5) mailed Jul. 25, 2011 in corresponding GB Application No. 1104781.8, 3 pgs.
International Search Report and Written Opinion of the International Searching Authority dated May 31, 2013 in corresponding PCT Application No. PCT/GB2012/050087, 14 pgs.
Office Action, and translation thereof, from counterpart Taiwan Patent Application No. 101104594, dated Mar. 9, 2016, 9 pp.

* cited by examiner

VACUUM PUMP WITH LONGITUDINAL AND ANNULAR SEALS

CROSS REFERENCE TO RELATED APPLICATIONS

This application is a national stage entry under 35 U.S.C. §371 of PCT Application No. PCT/GB2013/050087, filed Jan. 17, 2012, which claims the benefit of British Application No. 1104781.8, filed Mar. 22, 2011. The entire contents of PCT Application No. PCT/GB2012/050087 and British Patent Application No. 1104781.8 are incorporated herein by reference.

TECHNICAL FIELD

The invention relates to a vacuum pump, in particular a multi-stage vacuum pump and a stator of such a pump.

BACKGROUND

A vacuum pump may be formed by positive displacement pumps such as roots or claw pumps, having one or more pumping stages connected in series. Multi-stage pumps are desirable because they involve less manufacturing cost and assembly time compared to multiple single stage pumps in series.

Multi-stage roots or claw pumps may be manufactured and assembled in the form of a clamshell. As shown in FIG. 1, the stator 100 of such a pump comprises first and second half-shell stator components 102, 104 which together define a plurality of pumping chambers 106, 108, 110, 112, 114, 116. Each of the half-shells has first and second longitudinally extending faces which mutually engage with the respective longitudinally extending faces of the other half-shell when the half-shells are fitted together. Only the two longitudinally extending faces 118, 120 of half-shell 102 are visible in the Figure. During assembly the two half shells are brought together in a generally radial direction shown by the arrows R.

The stator 100 further comprises first and second end stator components 122, 124. When the half-shells have been fitted together, the first and second end components are fitted to respective end faces 126, 128 of the joined half-shells in a generally axial, or longitudinal, direction shown by arrows L. The inner faces 130, 132 of the end components mutually engage with respective end faces 126, 128 of the half-shells.

Each of the pumping chambers 106-116 is formed between transverse walls 134 of the half-shells. Only the transverse walls of half-shell 102 can be seen in FIG. 1. When the half-shells are assembled the transverse walls provide axial separation between one pumping chamber and an adjacent pumping chamber, or between the end pumping chambers 106, 116 and the end stator components. The present example shows a typical stator arrangement for a roots or claw pump having two longitudinally extending shafts (not shown) which are located in the apertures 136 formed in the transverse walls 134 when the half-shells are fitted together. Prior to assembly, rotors (not shown) are fitted to the shafts so that two rotors are located in each pumping chamber. Although not shown in this simplified drawing, the end components each have two apertures through which the shafts extend. The shafts are supported by bearings in the end components and driven by a motor and gear mechanism.

The multi-stage vacuum pump operates at pressures within the pumping chamber less than atmosphere and potentially as low as $10^{-3}$ mbar. Accordingly, there will be a pressure differential between atmosphere and the inside of the pump. Leakage of surrounding gas into the pump must therefore be prevented at the joints between the stator components, which are formed between the longitudinally extending surfaces 118, 120 of the half-shells and between the end faces 126, 128 of the half-shells and the inner faces 130, 132 of the end components. An adhesive is typically used to seal between the half-shells and between the half-shells and the end components, but the adhesive is particularly susceptible to damage by corrosive pumped gases, and is difficult and time consuming to apply consistently. It can also inhibit disassembly and maintenance.

A known alternative sealing arrangement is disclosed in US2002155014 providing a one piece sealing member comprising two longitudinal portions and two annular portions. The sealing member is however generally quite intricate to fit in place and expensive to manufacture.

SUMMARY

The present invention provides an improved seal arrangement for sealing a clam shell pump.

The present invention provides a vacuum pump comprising: first and second half-shell stator components defining at least one pumping chamber and for assembly together along respective longitudinally extending faces; first and second end stator components for assembly at respective longitudinal end faces of the first and second half-shell stator components; longitudinal seals for sealing between the first and second half-shell stator components when assembled together at the longitudinally extending faces; and annular seals for sealing between the first and second end stator components and the first and second half-shell stator components when assembled; wherein the longitudinal seals have end portions which abut against the annular seals for sealing therebetween and the first and second half-shell stator components have formations for resisting movement of the end portions away from the annular seals when the end portions are compressed between the first and second half-shell stator components.

Other preferred and/or optional features of the invention are defined in the accompanying claims.

BRIEF DESCRIPTION OF THE DRAWINGS

In order that the present invention may be well understood, some embodiments thereof will now be described in more detail, with reference to the accompanying drawings in which.

By way of background to the invention, US2002155014 discusses the problem of sealing a clam shell stator. In particular, it indicates that leakage lines exist between a longitudinal gasket providing peripheral radial sealing and O-rings providing axial sealing at the ends which results in unsatisfactory sealing. As a consequence the patent proposes a one-piece sealing member as discussed above.

DETAILED DESCRIPTION

Figure 1:
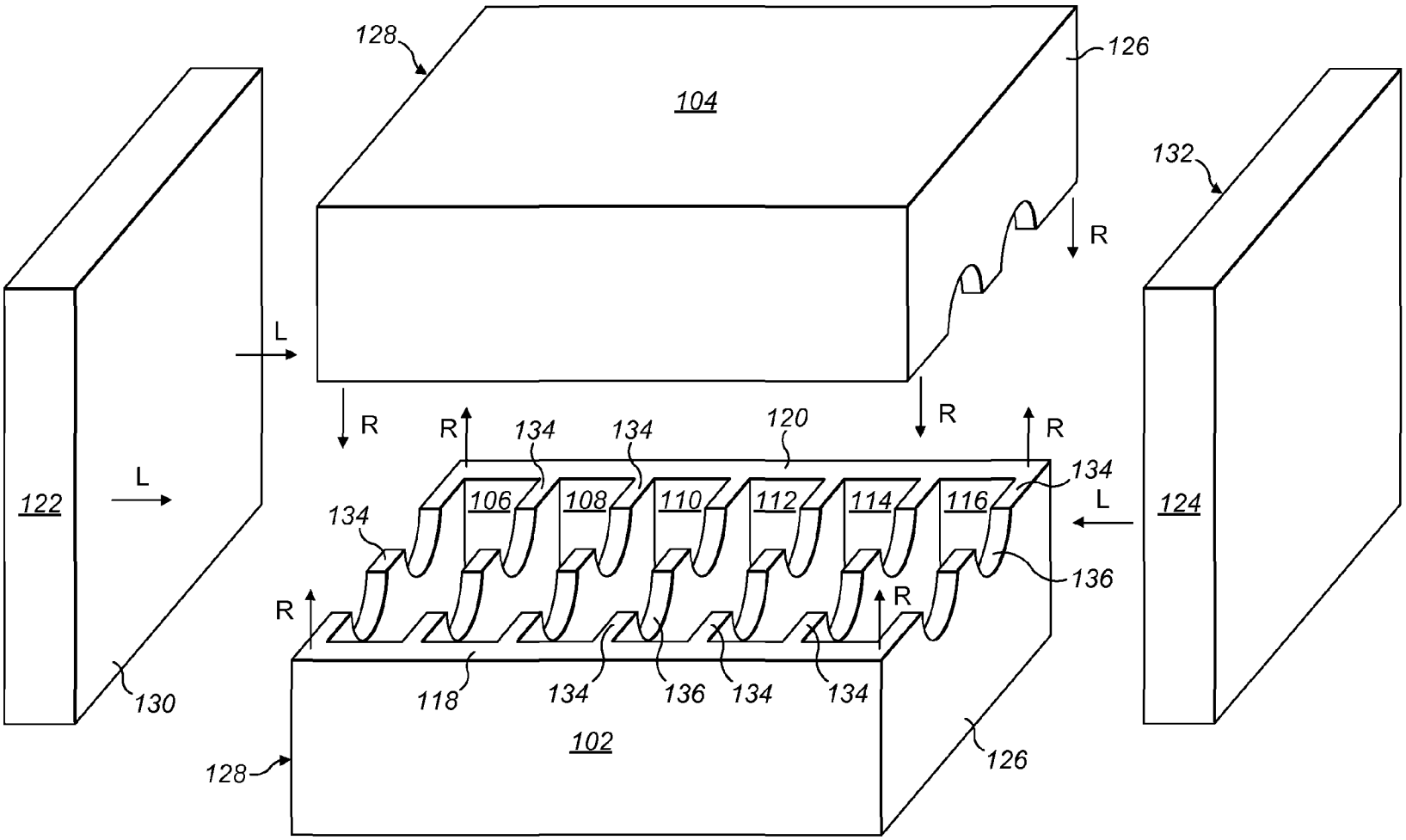
FIG. 1 shows generally the components of a clam shell stator.
Figure 2:
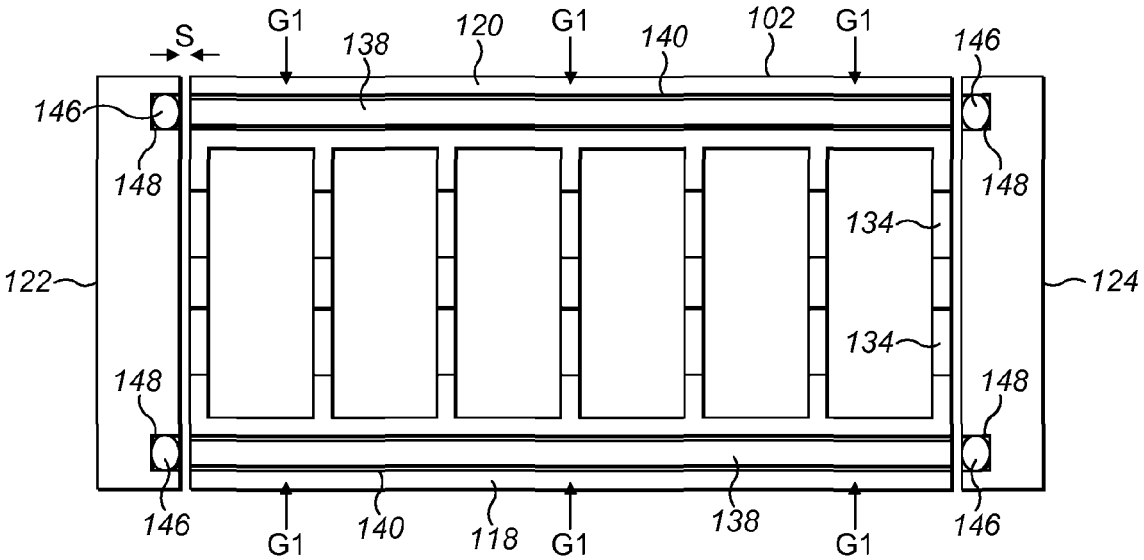
FIG. 2 shows a theoretically possible but undesirable sealing arrangement for the half-shell stator components and two stator end components provided for explanatory purposes only.
Figure 3:
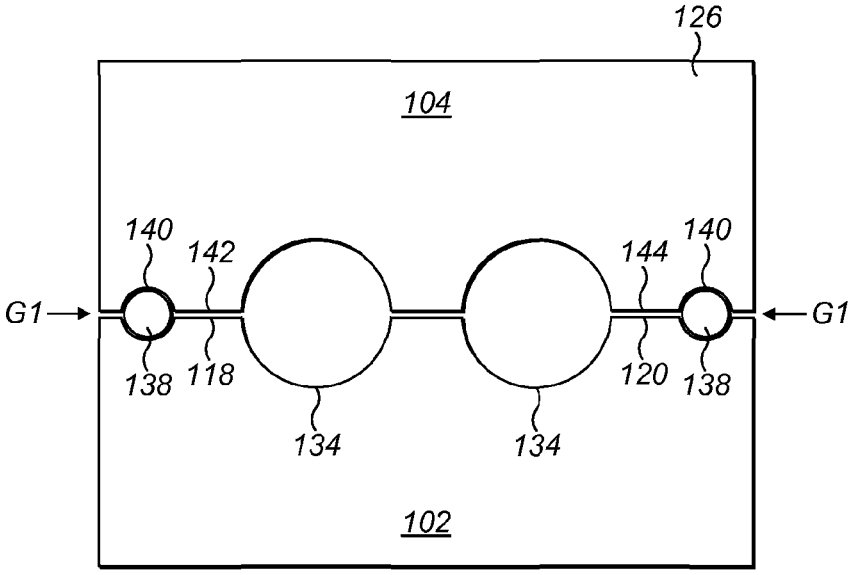
FIG. 3 shows a half-shell having the sealing arrangement of FIG. 2.
Figure 4:
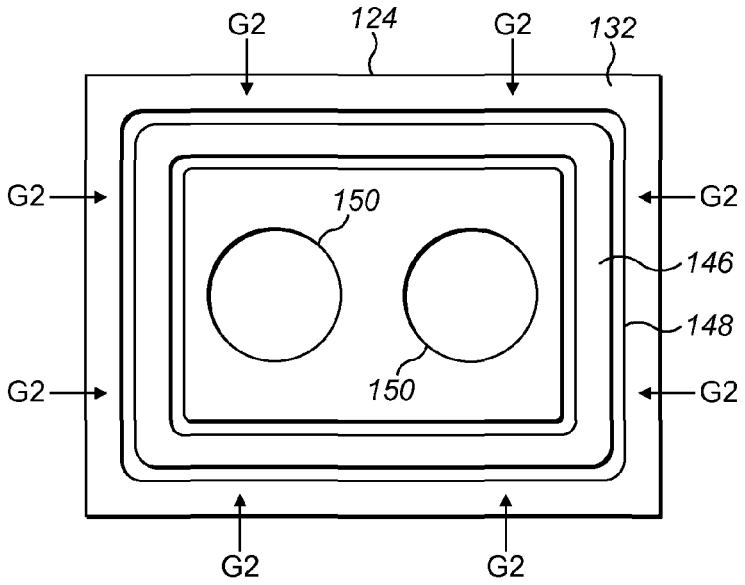
FIG. 4 shows an end component having the sealing arrangement of FIG. 2.

Looking in more detail now at this problem, FIG. 2 shows a plan view of the half-shell 102 and sections taken through end components 122, 124. FIG. 3 shows a view of one end face 126 of the joined half-shells 102, 104. FIG. 4 shows a view of an inner face 132 of an end component 124.

Referring to FIGS. 2 to 4, two longitudinal seal members 138 are located in channels 140 formed in the longitudinally extending faces 118, 120 and 142, 144 of the first and second half-shells 102, 104. The longitudinal seal members 138 resist leakage of ambient gases into the pump as shown by the arrows G1 over the length of the half-shells.

Two generally annular seal members 146 are located in respective generally annular channels 148 of the inner faces 130, 132 of the end components 122, 124. The seal members 146 resist leakage of ambient gases into the pump as shown by the arrows G2 over the periphery of the joint between the end components and the half-shells. Accordingly, the leakage of gases through the apertures 150 in the end components or the apertures 134 in the end of the joined half-shells is generally prevented.

A problem with this sealing arrangement is that an inconsistent seal is provided between the longitudinal seal members 138 and the annular seal members 146 as indicated by a space S shown in FIG. 2. The inconsistent seal allows leakage of gases between the two seal members 138, 146. The longitudinal seal members 138 are configured to be compressed between the two half-shells when they are assembled together to provide a tight fit. However, when compressed there is a tendency for some movement of the seal members 138 in the channels 140 whereby the space S may be created or increased. The longitudinal seal members can be manufactured with a longer length than the length of the channels 140, however, in this case compression between the half-shells may lead to kinking in the seal members causing leakage.

Figure 5:
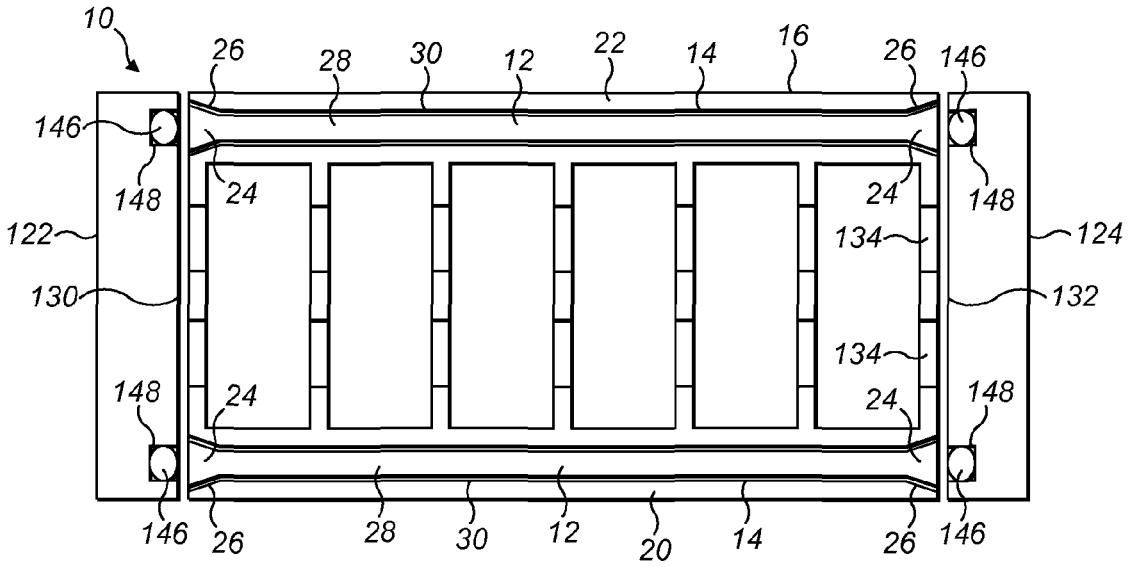
FIG. 5 shows a sealing arrangement for the half-shell stator components of a multi-stage vacuum pump and two stator end components according to an embodiment of the invention.

Referring now to a first embodiment of the invention shown in FIG. 5, part of a clam shell multi-stage vacuum pump is shown which is generally similar to the clam-shell pump discussed in detail in relation to FIGS. 1 to 4, except that the sealing arrangement is different. Accordingly, the general arrangement of the pump will not be described again and like features are given like references.

In FIG. 5, a section is taken through the end stator components 122, 124 and only one half-shell 16 is shown. The stator 10 comprises two longitudinally extending seal members 12 which are located in respective channels 14 of the half-shell stator components 16, 18. The channels 14 are recessed into the longitudinally extending faces 20, 22 of the half-shell 16. Only component 16 is shown in this Figure, although half-shell 18 preferably has a similar arrangement. When fitted together, the half-shells compress the seal members 12 causing slight expansion so that there is a gas tight fit between the seal members and the channels. Each pair of mutually engaging longitudinal faces may have a channel for locating a seal member 12 or alternatively only one such face may have a channel whilst the other face remains generally flat.

Figure 6:
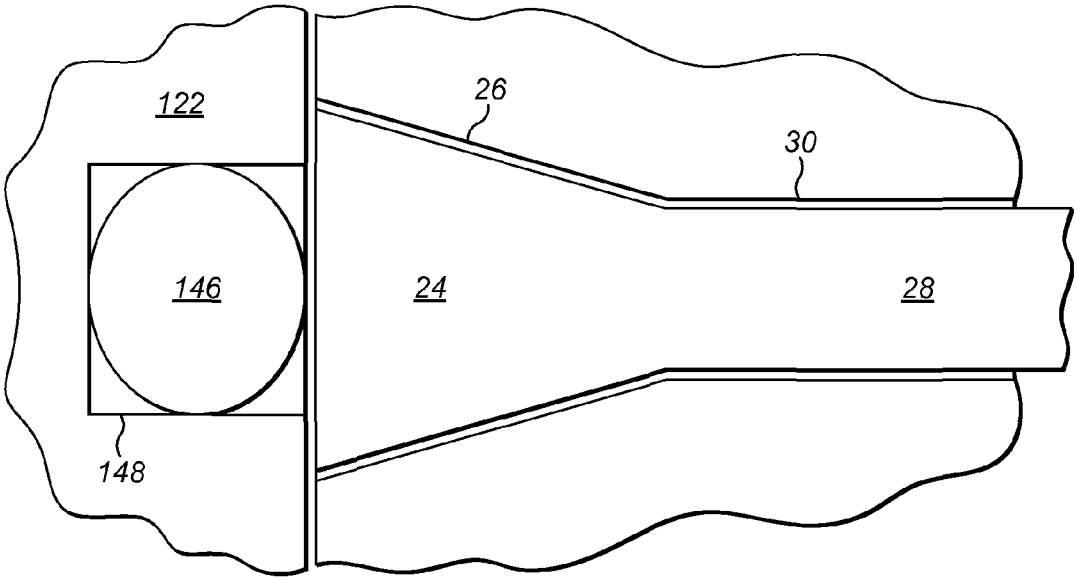
FIG. 6 shows in more detail a portion of the arrangement shown in FIG. 5.

The longitudinal end portions 24 of the seal members 12 are configured to co-operate with respective end portions 26 of the channels to resist movement of the seal end portions 24 away from the annular seal members 146 when the stator components are assembled and the seal members 12 are compressed. In this way, the end portions 24 are retained in contact with the annular seal members when the pump is assembled and in operation. In the present example, the end portions are enlarged compared to the middle portion 28 of the seal members. The end portions 26 of the channels are likewise enlarged compared to the middle portions 30 of the channels, and are shaped to complement the shape of the seal end portions 24. More particularly, and as shown in the enlarged drawing of FIG. 6, the end portions 24, 26 taper outwardly in two lateral dimensions (perpendicular to the longitudinal axis) and are in the form of truncated cones. Of course, there are numerous complementary configurations of the end portions 24, 26 which resist movement of the longitudinal seal away the annular seal. For example, the end portions may be trapezoidal having planar tapering sides (i.e. taper outwardly only in one lateral dimension) or may be rectilinear having sides which extend generally laterally to the longitudinal configuration of the seal members and channels.

The longitudinal seals 12 may be slightly shorter in length that the length of the channels 14 of the half-shells 16, 18 and require slight stretching in order fit in place. A small amount of tension in the middle portion 28 of the seals is generated between the end portions 24. The tension helps to ensure that the end portions 24 sit tightly against the end portions 26 of the channels so that movement away from the annular seals is resisted immediately upon initial compression.

Figure 7:
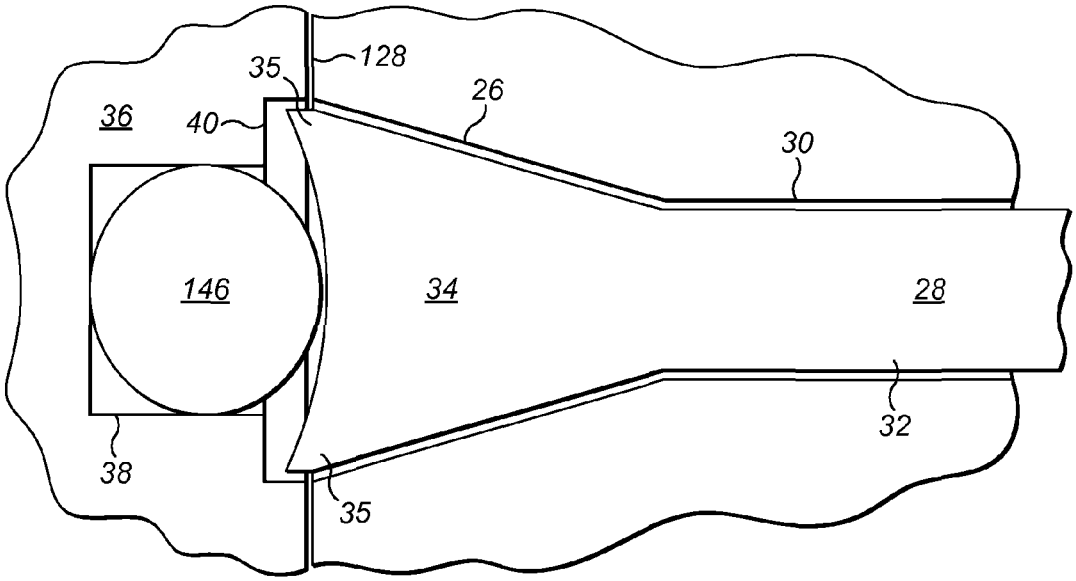
FIG. 7 shows in more detail a modified portion of the arrangement shown in FIGS. 5.
Figure 8:
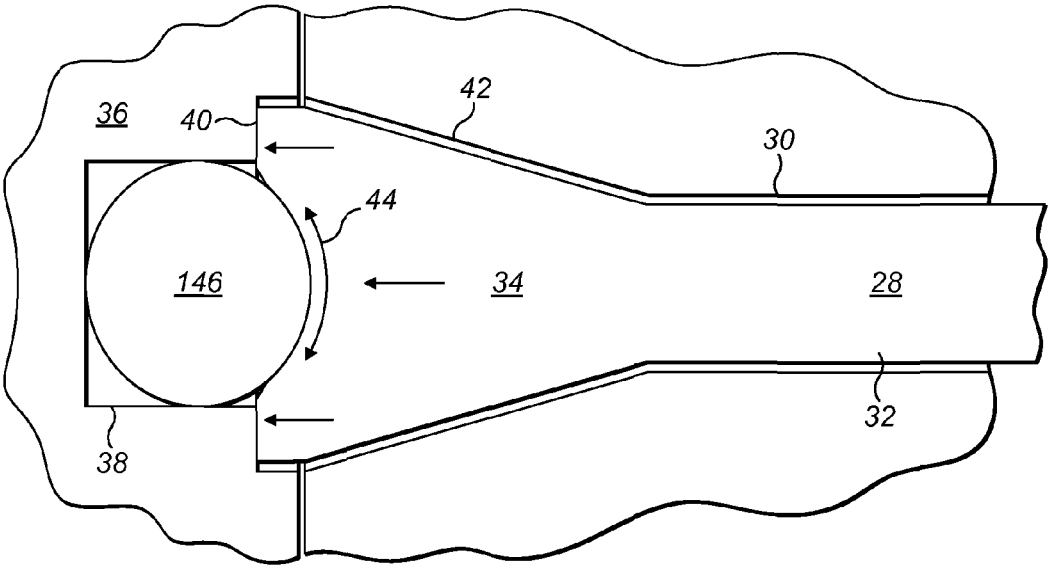
FIG. 8 shows the sealing arrangement of FIG. 7 when compressed during assembly.

In another arrangement shown in FIGS. 7 and 8, the seal end portions 32 are configured so that when the stator is assembled and the seal members are compressed, the longitudinal seal member expands towards the annular seal member. This expansion increases the sealing force between the seal members and preferably as shown in FIG. 8 also extends the sealing surface which resists the leakage of gas into the pump as the end portion is deformed against the annular seal.

In more detail, a longitudinal seal member 32 comprises a middle portion 28 which is generally cylindrical as previously described. The end portion 34 of the seal member has an end configuration which extends towards the annular seal member 146 to a greater extent on either side of the annular seal and is configured to sit proud of the end face of the half-shells. As shown in FIG. 7, the end configuration is generally curved. When uncompressed, the end protrusions 35 preferably overlap with the annular seal 146 in the longitudinal direction so that less expansion is required during compression in order to form a good seal between the two seals. The end component 36 in this arrangement comprises a generally annular channel 38 for receiving the annular seal. Additionally a recess 40 is formed in the surface 130 of the end component in the region of the longitudinal seal. As shown in FIG. 8, when the seal is compressed the end portion of the channel 42 of the half-shells resists movement of the end portion 34 away from the annular seal and results in the end portion expanding towards the annular seal as shown by the arrows. The provision of the recess 40 in this example allows the end portion 34 to expand around the cross-section of the annular seal member. Accordingly, the sealing force between the seals is increased and the sealing surface 44 is extended adopting an arcuate interface. Although not specifically shown in FIGS. 7 and 8, and depending on the material properties of the longitudinal seal and the annular seal, the annular seal may also be deformed by movement of the longitudinal seals towards it during assembly.

Figure 9:
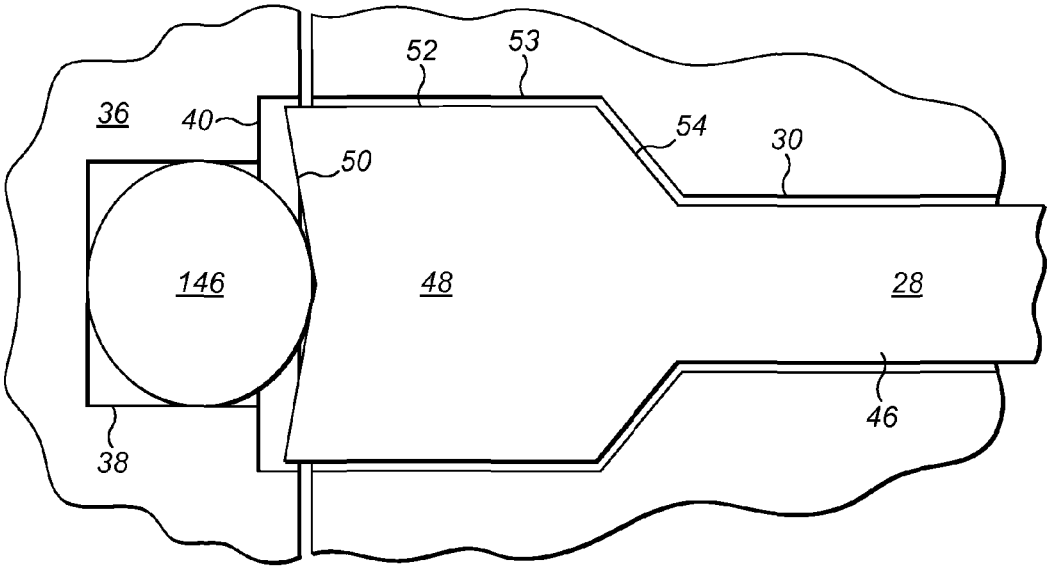
FIG. 9 shows in more detail a further modified portion of the arrangement shown in FIG. 5.

In an alternative arrangement shown in FIG. 9, a longitudinal seal member 46 may have an end portion 48 which is configured like a fledge of an arrow, having an end surface 50 which tapers inwardly, two parallel generally straight sides 52 and a surface 54 which tapers towards the middle portion 28. The end portion 53 of the channel of the half-shells is configured to complement the shape of the end portion 48 and to resist its movement away from the annular seal. End portions 48 function in a similar way when compressed to the end portions 34 described above in relation to FIGS. 7 and 8, such that the sealing force between the seals 46 and 146 is increased and the leakage path is extended.

Figure 10:
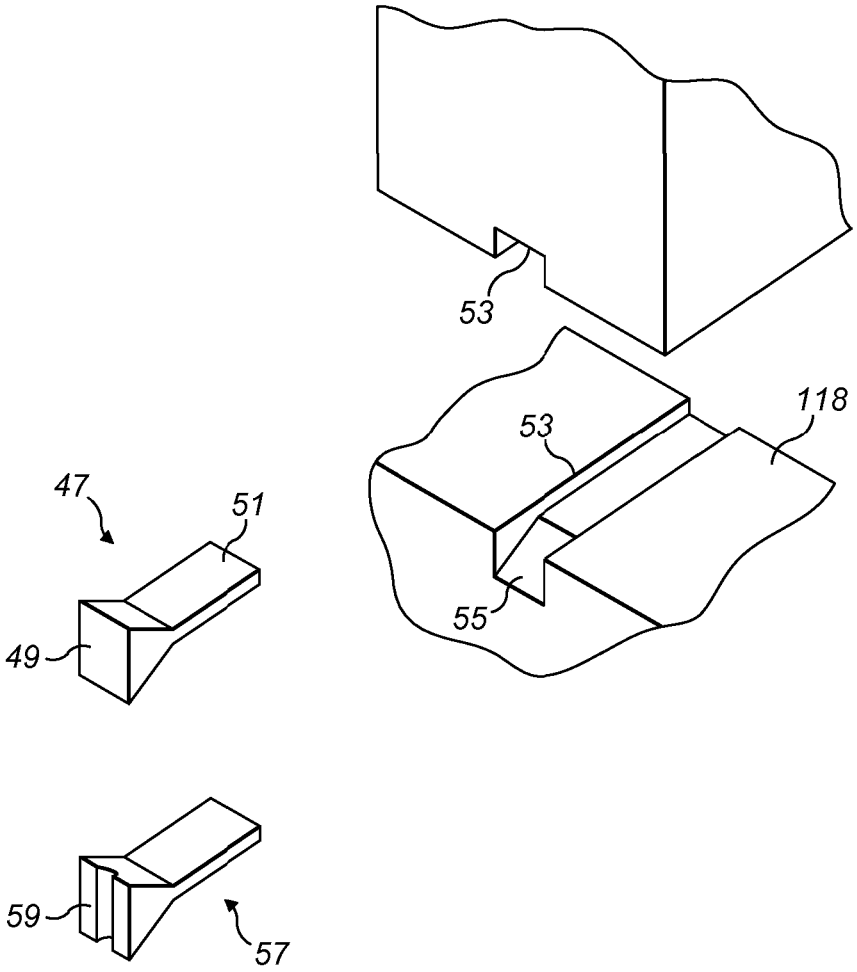
FIG. 10 shows a sealing arrangement according to further embodiments of the invention.

In a further arrangement shown in FIG. 10, a longitudinal seal member 47 may have an end portion 49 which is generally trapezoidal with upper and lower surfaces (as orientated in the Figure) that taper outwardly from a generally flat middle portion 51 and side surfaces that do not taper. The channel 53 in the longitudinal sealing surface has an end portion 55 which is shaped to complement the end portion 49 of the seal member 47. In a modification, a seal member 57 has a generally circular groove 59 for receiving an annular sealing member and for extending the sealing surface between members.

Figure 11:
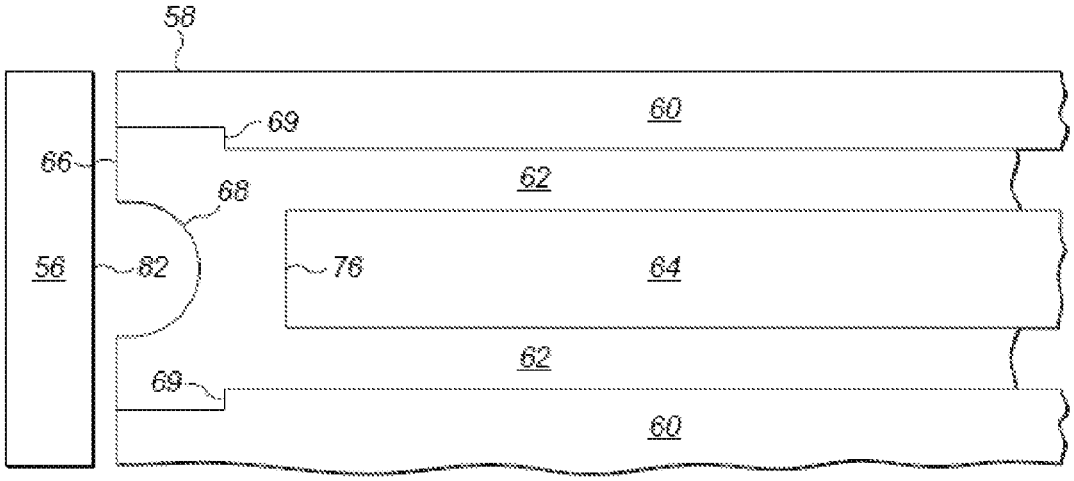
FIG. 11 shows a half-shell and end stator component according to another sealing arrangement.

A further embodiment of the invention is shown in FIGS. 11 to 14. FIG. 11 shows, in enlarged view, portions of the end component 56 and half-shell 58 without longitudinal or annular sealing members. A longitudinally extending face 60 of the half-shell has countersunk into its surface a longitudinal recess, or channel, 62 for locating the longitudinally extending seal member (shown in FIG. 12). Upstanding generally orthogonally from the recess is a wall 64 having an upper surface which is flush with the face 60. In another arrangement the wall may extend into the recess of the opposing half-shell. The end face 66 of the half-shell has countersunk therein a generally annular channel 68 for receiving an annular seal member (shown in FIG. 13). FIG. 11 shows only a cross-section of the annular channel 68 which is generally perpendicular to and formed in the recess 62. A recessed shoulder 69 is formed for co-operating with a locating shoulder of the longitudinal seal member as described in more detail below.

Figure 12:
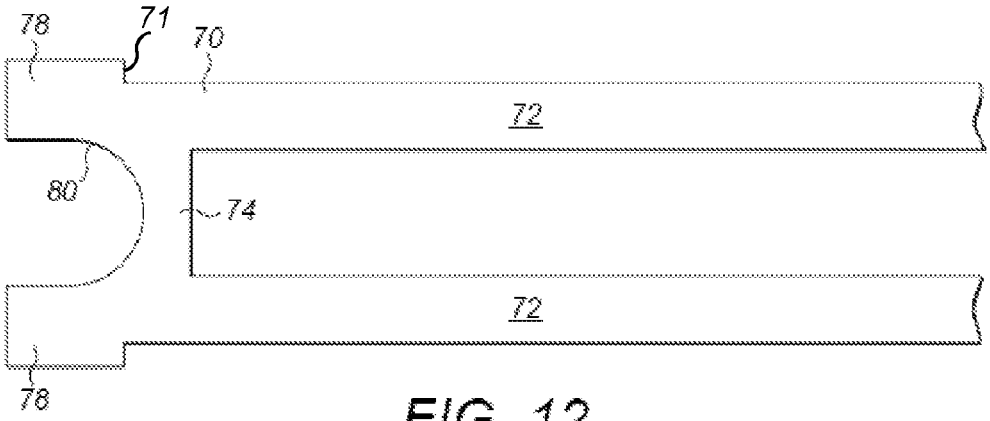
FIG. 12 shows a longitudinal seal for location in the channel shown in FIG. 11.

A longitudinal seal member 70 is shown in FIG. 12 and is shaped to complement the shape of the recess 62. Seal 70 comprises two elongate portions 72 which fit in the recess 62 and are laterally spaced apart for fitting closely adjacent the upstanding wall 64. A laterally extending portion 74 of the seal extends between the elongate portions and is configured to be closely adjacent an end 76 of the wall. A claw shaped formation extends from the laterally extending portion 74, having two protrusions 78 and a generally semi-circular recess 80 similar in size and shape to the cross-section of the annular channel 68. The end stator component 56 has a generally planar inner face 82 for compressing the annular seal member when it is located in the annular channel 68. Locating shoulders 71 extend laterally outwardly for co-operating with recessed shoulders 69 of the channel 62.

Figure 13:
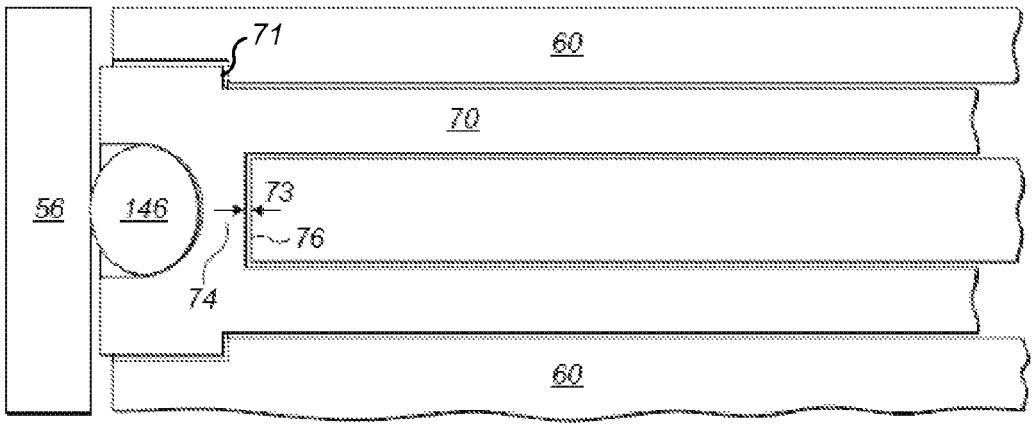
FIG. 13 shows the longitudinal seal of FIG. 12 located in position in the half-shell stator component shown in FIG. 11 together with an annular seal but prior to final assembly and compression.

FIG. 13 shows the annular seal member 146 and the longitudinal seal member 70 fitted in place in the stator half shell but prior to full assembly and compression. It will be seen that in this condition, the locating shoulders 71 of the seal member sit flush against respective recessed shoulders 69 of the channel. In this way, the seal member can easily be fitted in its correct position in the channel. Prior to compression a gap 73 exists between the end surface 76 of the wall and the lateral portion 74 of the seal member. The size of the gap 73 can be controlled within design tolerances to increase or decrease the force applied by the longitudinal seal member to the annular seal member during final assembly and compression.

Figure 14:
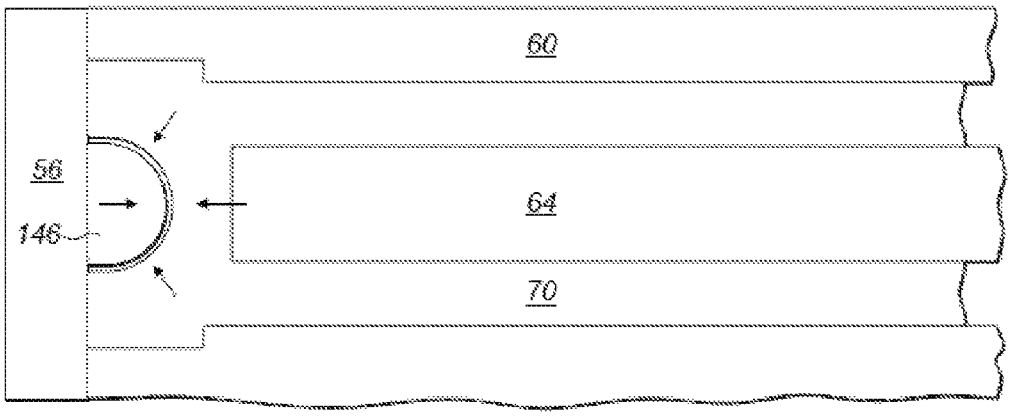
FIG. 14 shows the seal in FIG. 11 in use after final assembly and compression.

As shown in FIG. 14 after final compression, the longitudinal seal member 70 and the annular seal member 146 are compressed respectively between half shells 58 on the one hand and between the half-shells 58 and the end component 56 on the other hand, and the lateral portion 74 of the longitudinal seal member expands into the gap 73 and abuts against the wall 76. The lateral portion also expands towards the annular seal member and the claws 78 expand laterally towards the annular seal member as shown by the arrows. Preferably, the seals deform to some extent to provide a tight fit and a good seal. Whilst the seals are deformed against each other a generally semi-circular sealing surface is formed which resists leakage into the stator.

The longitudinal seal member in the embodiments described above may take the form of a gasket having a generally flat configuration in which it has greater extent in two dimensions and less extent in a third dimension. The gaskets may be formed from a relatively hard material such as a metal. In this case, it is important to control the sealing force between the gasket and the annular seal member so that the gasket does not damage the annular seal member when they are compressed together.

The invention claimed is:

1. A method comprising:

assembling longitudinal seals between a first half-shell stator component and a second half-shell stator component along a first longitudinally extending face of the first half-shell stator component and a second longitudinally extending face of the second half-shell stator component to form a seal between the first and second half-shell stator components, wherein the first and second half-shell stator components define a plurality of pumping chambers; and assembling annular seals that are separate from the longitudinal seals between a first end stator component at a first longitudinal end face of the first half-shell stator component and between a second end stator component at a second longitudinal end face of the second half-shell stator components to form a seal between the first and second end stator components and the first and second half-shell stator components, wherein the longitudinal seals have end portions which abut against the annular seals to seal therebetween and the first and second half-shell stator components have formations that resist movement of the end portions away from the annular seals when the end portions are compressed between the first and second half-shell stator components.

2. The method of claim 1, wherein the first and second longitudinally extending faces of the first and second half-shell stator components form therebetween respective longitudinal channels for locating the longitudinal seals, and wherein the formations are formed by enlarged end portions of the longitudinal channels which are configured for receiving enlarged end portions of the longitudinal seals.

3. The method of claim 2, wherein the enlarged end portions of the longitudinal channels and the enlarged end portions of the longitudinal seals taper laterally outwardly from middle portions thereof.

4. The method of claim 1, wherein the end portions of the longitudinal seals are configured such that, when compressed during assembly, the end portions of the longitudinal seals deform against the annular seals to extend a sealing surface therebetween.

5. The method of claim 1, wherein the end portions of the longitudinal seals comprise longitudinal protrusions having a recess therebetween shaped to complement a cross-section of a respective annular seal of the annular seals so that, when assembled, a portion of the annular seal is located in the recess and a sealing surface is extended between the seals.

6. The method of claim 1, wherein the first half-shell stator component comprises a first end face and the second half-shell stator component comprises a second end face, wherein the first and second end faces, when assembled together, form annular channels for locating the annular seals, and the annular channels extend through the end portions of the longitudinal channels.

7. The method of claim 1, wherein the longitudinal channels are recessed into the longitudinally extending faces of the first and second half-shell stator components and longitudinal walls upstand from the recessed longitudinal channels and are generally flush with the longitudinally extending faces, and wherein the longitudinal seals fit around the longitudinal walls such that, when compressed, the longitudinal walls prevent the longitudinal seals from the deforming away from the annular seals.

8. The method of claim 1, wherein, when located in position in the first and second half-shell stator components and prior to compression, a gap exists between the longitudinal seals and the formations of the first and second half-shell components into which the longitudinal seals can expand during compression.

9. A multi-stage vacuum pump comprising:

a first half-shell stator component comprising a first longitudinally extending face;

a second half-shell stator component comprising a second longitudinally extending face, wherein the first and second half-shell stator components together define a plurality of pumping chambers and are assembled together along the first and second longitudinally extending faces;

a first end stator component;

a second end stator component, wherein the first and second end stator components are assembled at respective longitudinal end faces of the first and second half-shell stator components;

longitudinal seals that seal between the first and second half-shell stator components; and annular seals separate from the longitudinal seals that seal between the first and second end stator components and the first and second half-shell stator components;

wherein the longitudinal seals have end portions which abut against the annular seals to seal therebetween and the first and second half-shell stator components have formations that resist movement of the end portions of the longitudinal seals away from the annular seals when the end portions are compressed between the first and second half-shell stator components.

10. The multi-stage vacuum pump of claim 9, wherein the first and second longitudinally extending faces of the first and second half-shell stator components form therebetween respective longitudinal channels for locating the longitudinal seals, and wherein the formations are formed by enlarged end portions of the longitudinal channels which are configured for receiving enlarged end portions of the longitudinal seals.

11. The multi-stage vacuum pump of claim 10, wherein the enlarged end portions of the longitudinal channels and the enlarged end portions of the longitudinal seals taper laterally outwardly from middle portions thereof.

12. The multi-stage vacuum pump of claim 11, wherein the enlarged end portions of the longitudinal channels and the enlarged end portions of the longitudinal seals taper outwardly in at least two orthogonal lateral dimensions from middle portions thereof.

13. The multi-stage vacuum pump of claim 10, wherein, when located in the longitudinal channels, the end portions of the longitudinal seals extend beyond the end faces of the first and second half-shell stator components and against the annular seals.

14. The multi-stage vacuum pump of claim 9, wherein the end portions of the longitudinal seals are configured such that, when compressed during assembly, the end portions of the longitudinal seals deform against the annular seals to extend a sealing surface therebetween.

15. The multi-stage vacuum pump of claim 9, wherein the end portions of the longitudinal seals comprise longitudinal protrusions having a recess therebetween shaped to complement a cross-section of a respective annular seal of the annular seals so that, when assembled, a portion of the annular seal is located in the recess and a sealing surface is extended between the seals.

16. The multi-stage vacuum pump of claim 9, wherein the first half-shell stator component comprises a first end face and the second half-shell stator component comprises a second end face, wherein the first and second end faces, when assembled together, form annular channels for locating the annular seals, and the annular channels extend through the end portions of the longitudinal channels.

17. The multi-stage vacuum pump of claim 9, wherein the longitudinal channels are recessed into the longitudinally extending faces of the first and second half-shell stator components and longitudinal walls upstand from the recessed longitudinal channels and are generally flush with the longitudinally extending faces, and wherein the longitudinal seals fit around the longitudinal walls such that, when compressed, the longitudinal walls prevent the longitudinal seals from the deforming away from the annular seals.

18. The multi-stage vacuum pump of claim 9, wherein the longitudinal seals and the formations of the first and second half-shell stator components resist movement of a sealing surface of the longitudinal seals away from respective annular seals.

19. The multi-stage vacuum pump of claim 9, wherein, when located in position in the first and second half-shell stator components and prior to compression, a gap exists between the longitudinal seals and the formations of the first and second half-shell components into which the longitudinal seals can expand during compression.

20. The multi-stage vacuum pump of claim 9, wherein the longitudinal seals are gaskets having a greater extent in two dimensions and a lesser extent in a third dimension.

* * * * *